United States Patent [19]

Kitahara

[11] 4,111,627

[45] Sep. 5, 1978

[54] APPARATUS FOR MOLDING CONCRETE-BLOCKS

[75] Inventor: Yutaka Kitahara, Takahashi, Japan

[73] Assignee: Kabushiki Kaisha Tiger Machine Seisakusho, Takahashi, Japan

[21] Appl. No.: 782,382

[22] Filed: Mar. 29, 1977

[51] Int. Cl.[2] ..... B28B 3/04

[52] U.S. Cl. ..... 425/421; 425/422; 425/432

[58] Field of Search ..... 425/421, 422, 432, 443, 425/444

[56] References Cited

U.S. PATENT DOCUMENTS

| | | | |
|---|---|---|---|
| 2,589,115 | 3/1952 | Nelson et al. | 425/432 |
| 2,819,046 | 1/1958 | Jandris et al. | 425/432 |
| 2,831,230 | 4/1958 | Neth et al. | 425/421 |
| 3,264,702 | 8/1966 | Clanton et al. | 425/422 |
| 3,277,551 | 10/1966 | Sekiguchi | 424/421 |

*Primary Examiner*—Francis S. Husar
*Assistant Examiner*—John McQuade
*Attorney, Agent, or Firm*—Birch, Stewart, Kolasch & Birch

[57] ABSTRACT

An apparatus for molding concrete-blocks within a molding box which is suspended, whereby vibrations are applied to the molding box uniformly in all the directions, that is, up and down, left and right, back and forth during the molding process. Uneven distribution of the concrete aggregates is avoided and homogeneous, high density and high quality concrete-blocks can be molded efficiently. Furthermore, this apparatus is provided with means to prevent transmission of the vibrations to the apparatus body.

18 Claims, 5 Drawing Figures

APPARATUS FOR MOLDING CONCRETE-BLOCKS

BACKGROUND OF THE INVENTION

This invention relates in general to an apparatus for molding concrete-blocks and in particular to an improved apparatus for molding concrete-blocks employing a vibration system.

In the apparatus for molding concrete-blocks, it is necessary to use light-weight aggregates, with a reduced water-cement ratio and to speedily eject the molded concrete-blocks from the molding box.

In order to do this, it is desirable to pack the concrete materials closely in the molding process while strong vibrations are being applied to the molding box.

However, in the conventional vibration type molding apparatus, it is difficult to apply the vibrations to the molding box uniformly since the vibrations are not applied equally to all directions, but are apt to apply vibrations to a certain direction. Moreover, in the conventional apparatus, the vibrations are directly transmitted to a body of the apparatus for mechanical reasons and such transmissions of the vibrations are repeated. This often causes a breakdown of the apparatus. Therefore, it is very difficult to produce homogeneous molded concrete-blocks by the conventional apparatus.

In order to overcome the problems and difficulties presented by the conventional molding apparatus, a very complicated mechanism is required. Thus, so far, an ideal molding apparatus has not been developed.

SUMMARY OF THE INVENTION

It is, therefore, an object of this invention to provide an apparatus for producing homogeneous, high density and high quality concrete-blocks.

Another object of this invention is to prevent directional transmittance of the vibrations to the body of the apparatus in order to protect the framework and other parts of the apparatus from the adverse effects of the vibrations.

These and other objects are obtained in accordance with the present invention wherein an apparatus for molding concrete-blocks employing a vibration system is operated in a suspended condition, with a molding box for use in the vibration molding process being unfixed in order to apply vibrations uniformly to the molding box in all the directions, that is, up and down, left and right, back and forth of the box, whereby homogeneous high density and high quality concrete-blocks are obtained.

In the present invention, the molding box is suspended in the manner as discussed below.

During the molding process, the molding box is placed on a product receiving plate which is supported by a plurality of supports which are fixed on a suspension type table frame. This table frame is suspended from an upper frame through spring means. Thus, the molding box is indirectly suspended from the upper frame. At the same time, the molding box is pulled from both sides thereof by a plurality of transmission belts connected with motors, placed on both sides of the molding box, which give strong vibrations to the molding box through a pair of vibration shafts. The motors are fixed on one or more pairs of motor fixing plates which are pivotally mounted on a pair of side plates of the apparatus. Thus, the motors are movable upward or downward to a certain extent by the adjustment of the position of the motor fixing plates.

Consequently, the molding box is supported in suspension by both the suspension type table frame and the tension of the transmission belts of the motors.

This arrangement of the tble frame and the motors permits uniform application of the vibrations to the molding box. Moreover, by this arrangement, the molding box can be set at a predetermined position.

The vibrations employed in the apparatus are high-powered. However, the motor fixing plates are movable through the base plates and as mentioned previously, the table frame is suspended from the upper frame through spring means. Moreover, a press frame which applies pressure to the concrete materials in the molding box is also provided with spring means.

Therefore, the vibrations from the motors and the press frame are almost absorbed by said spring means and are scarcely transmitted to the framework and other parts of the apparatus, whereby the framework and other parts of the apparatus are protected from the adverse effects of the vibrations.

Such vibration adsorption improves the smooth operation of the table frame and the press frame. Consequently, it improves the stable production of accurate size concrete-blocks.

In addition, the fact that the vibrations generated in the apparatus are absorbed inside the apparatus is advantageous to the installment of the apparatus.

As another feature of the apparatus according to the present invention, concrete-block products with various heights can be molded in the same apparatus only by replacing height-limitation members attached to the piston rods which suspend the table frame.

As another feature of this invention, since the molded products are homogeneous, of high density and of high quality, they can be extruded from the molding box, being held between the press frame and the product receiving board, resulting in few damages of the products and the efficient production of concrete-blocks.

In view of the overall construction of this apparatus, as the table frame is of a suspension type, there are no complicated devices or parts in the lower portion of the apparatus. This permits easy maintenance and inspection and cleaning of the apparatus. Thus, resulting in the attainment of a high durability of the apparatus.

Other objects and further scope of applicability of the present invention will become apparent from the detailed description given hereinafter; it should be understood however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

In the above figures, the identical parts are given the identical numerals or reference characters.

DETAILED DESCRIPTION OF PREFERRED EMBODIMENT

Figure 1:
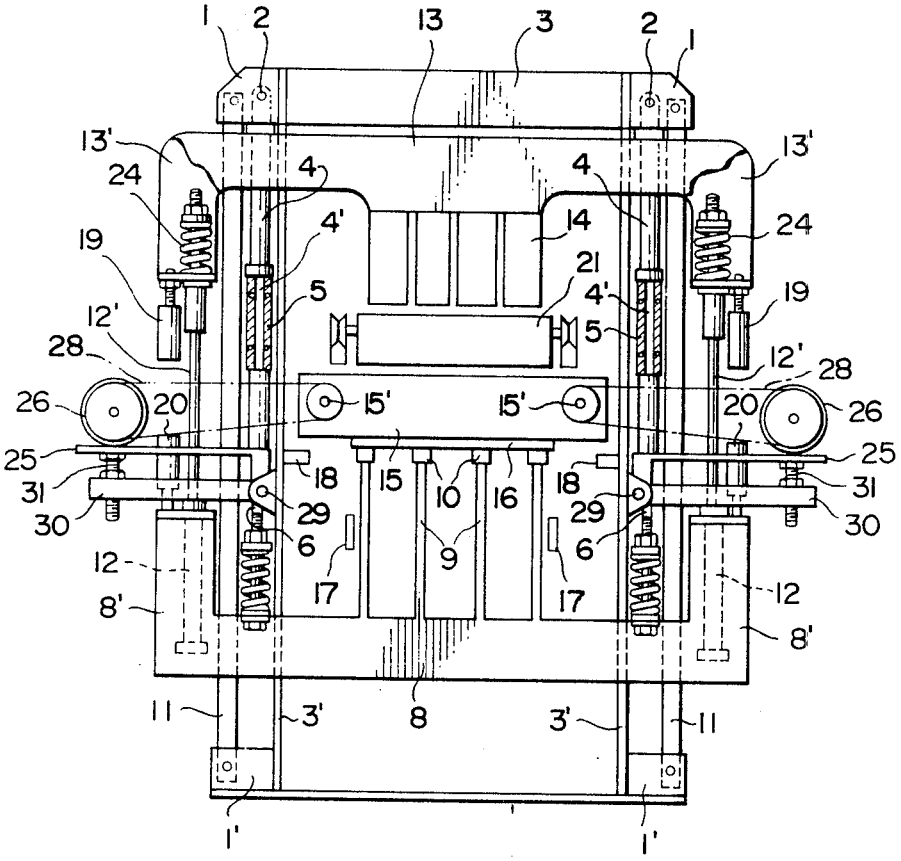
FIG. 1 is a front sectional view of the embodiment of this invention at the time of concrete material feeding.

FIG. 1 is a front sectional view of the apparatus for molding concrete-blocks of this invention when concrete materials are being fed to a molding box 15. A partially cutaway view is included in this figure. A pair of upper support members 1, 1 project from opposite sides of an upper frame 3, and a pair of lower support members 1', 1' also project from at the lower side of a pair of side plates 3', 3'. A pair of guide rods 11, 11 are vertically positioned between these support members 1, 1 and 1', 1' with the support members 1, 1 and 1', 1' being fixed to the upper and lower ends of the guide rods 11, 11.

The upper oil pressure ends of a pair of upper cylinders 4, 4, which are disposed in parallel with the guide rods 11, 11 are pivotally mounted on the support members 1, 1 by means of a pair of shafts 2, 2. The lower ends of a pair of piston rods 4', 4' of the upper oil pressure cylinders 4, 4 are connected with both ends of a table frame 8 through a pair of suspension members 6, 6 so that the table frame 8 is suspended.

The piston rods 4', 4' of the upper oil pressure cylinders 4, 4 are provided with a pair of height limitation members 5, 5 which correspond to the height of a concrete-block to be molded. These height limitation members can be replaced with other height limitation members in accordance with the size of the product.

At both ends of the table frame 8, a pair of support members 8', 8' project upwardly and a pair of lower oil pressure cylinders 12, 12 are vertically fixed thereon. The upper ends of the piston rods 12', 12' are attached to a pair of support members 13', 13' of an press frame 13.

At a central portion of the press frame 13, a mold plunger 14 is provided. The mold plunger 14 is moved by the piston rod 12' and the cylinders 12, 12. In operation, as the press frame 13 is moved downwardly the plunger 14 compresses the concrete material within the mold box 15.

The table frame 8 is provided with a plurality of supports 9 to place a product receiving plate 16 thereon. In addition, the tops of the supports 9 are provided with shock absorbing rubbers 10.

Moreover, positioned at opposite sides of the group of supports 9 are a pair of delivery rails 17, 17 for the molded products.

A feed box 21 which moves forward and backward to feed the concrete materials into the molding box 15 is disposed above the molding box 15.

The molding box 15 is positioned in between the mold plunger 14 and the product receiving plate 16.

The stoppers 18, 18 which project inwardly from the inside of the side plates 3', 3', limit the downward movement of the molding box 15.

The molding box 15 is provided with a pair of vibration shafts 15', 15'. The vibration shafts 15', 15 and the pulleys of two pairs of motors 26, 26, 26, 26, are mounted outside the side plates 3', 3' and connected with two pairs of transmission belts 28, 28, 28, 28.

Two motors 26, 26 are attached to each side plate 3' in the following manner: Four motor fixing plates 25, 25, 25, 25 are pivotally mounted on a pair of shafts 29, 29.

Each motor fixing plate 25 on which one unit of the motor 26 is mounted is pivotally mounted on each side plate 3' through the shaft 29. Each motor fixing plate 25 slants under the weight of the motor 26. However, its downward movement is limited by an adjustable limiting member 31 attached to a support plate 30 on each side of the apparatus. Each motor 26 is pulled by a transmission belt 28 connected with the pulley of the motor 26 so as to position the molding box 15 at a predetermined position. Thus, the transmission belt 28 permits a secure transmission of the turning force of the motor 26 to the vibration shaft 15 without any slip.

Figure 5:
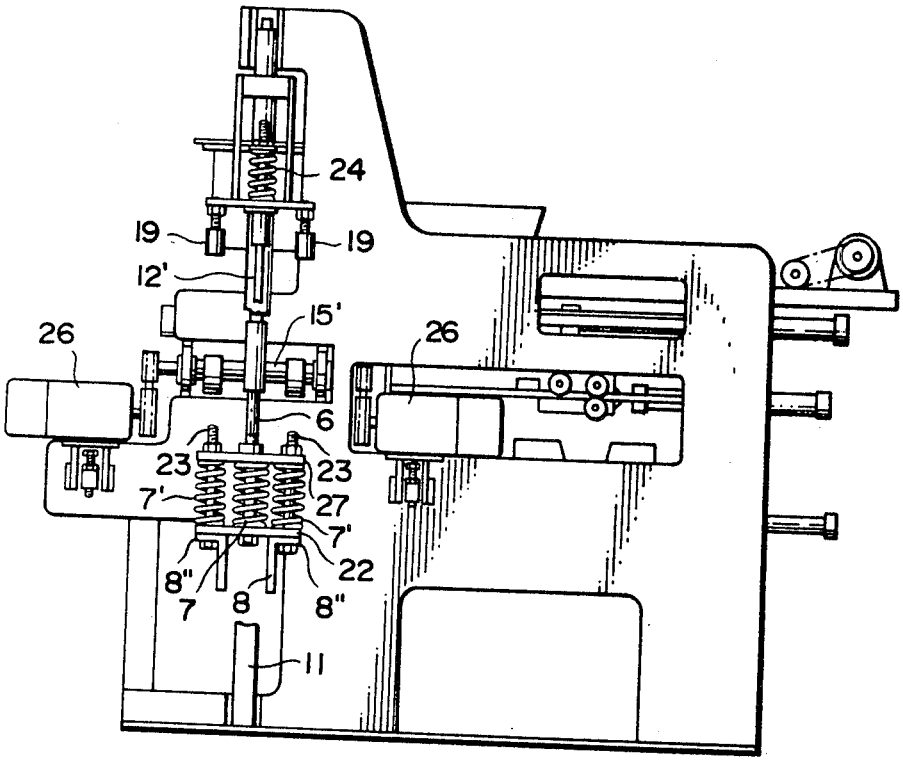
FIG. 5 is a side sectional view of the embodiment of this invention at the time of concrete material feeding.

FIG. 5 illustrates the connection between the suspension members 6, 6 and the table frame 8. On each side of the apparatus, the suspension member 6 is not directly connected with the table frame 8. Each suspension member 6 passes freely through the center of a respective adjustment plate 27, and is equipped with a pair of springs 7, 7. The lower end of each suspension member 6 is fixed to a support plate 22. On each side of the apparatus, a pair of adjustment bolts 23, 23, pass through the support plate 22, and the upper ends and the lower ends of the bolts 23, 23, are fixed to the adjustment plate 27, and to a pair of base plates 8'', 8'', which are secured to the table frame 8. The adjustment bolts 23, 23 between the adjustment plate 27 and the support plate 22 are equipped with a pair of springs 7', 7'.

The suspension members 6, 6 lift the support plates 22, 22 against the resilience of the springs 7, 7, and the support plates 22, 22 push up the adjustment plates 27, 27 against the resilience of the springs 7', 7', 7', 7'. The adjustment plates 27, 27 lift the base plates 8'', 8'', 8'', 8'' by the adjustment bolts 23, 23, 23, 23. Consequently, the suspension members 6, 6 lift the table frame 8. Therefore, the vibrations generated in the table frame 8 are absorbed by the springs 7, 7, 7', 7', 7', 7' so that they are not transmitted to the framework of the apparatus.

In FIGS. 1 - 4, illustrate a cutaway view of the fitting condition of a pair of piston rods 12', 12' and the support members 13', 13' of the press frame 13. As can be seen from these figures, the top of each piston rod 12' which passes through the lower surface of the support member 13. The piston rod 12' is equipped with a spring 24 which is fixed thereto.

Due to this construction, the vibrations generated in the table frame 8 or in the press frame 13 are absorbed by the springs 24, 24.

Thus, in addition to the action of said springs 7, 7, 7', 7', 7', 7', transmission of the vibrations to the apparatus framework is prevented. The numerals 19, 19, 20, 20 are the operation limiting members having such a function as hereinafter described in detail.

The operation of the apparatus of the present invention is as follows:

Referring now to FIG. 1, the press frame 13 and the table frame 8 are spaced apart from each other and the plunger 14 is disposed above the molding box 15. The feed box 21 is forwarded between the plunger 14 and the molding box 15.

The product receiving plate 16, which is placed on the supports 9 through the buffer rubbers 10, is brought into contact with the lower surface of the molding box 15. Subsequently the concrete materials are fed to the molding box 15 from the feed box 14. At this time, the height limitation members 5, 5 with an appropriate height are selected in accordance with the size of the products and attached to the piston rods 4', 4'.

Figure 2:
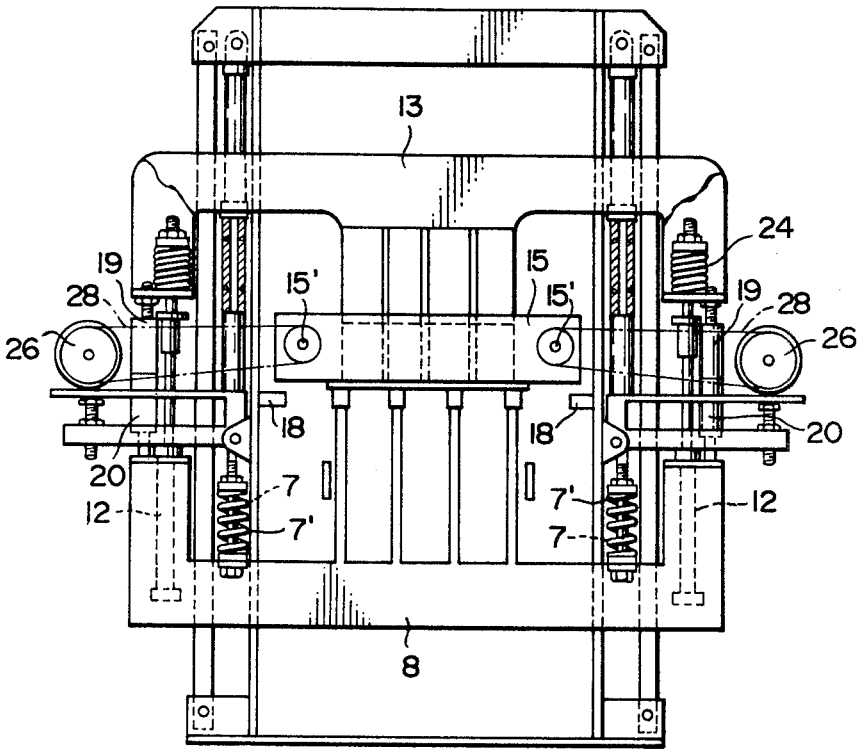
FIG. 2 is a front sectional view of the embodiment of this invention in the molding process.

FIG. 2 illustrates a stage when molding work is being performed. The press frame 13 is moved downward by the oil pressure of the lower cylinders 12, 12, and two pairs of operation limiting members 19, 19 and 20, 20 are in close contact with each other and become integrated with the table frame 8. As shown in FIG. 2, a pair of the operation limiting members 19, 19 are fixed to the respective support members 13', 13' of the press frame 13. Another pair of operation limiting members are fixed to the respective support members 8', 8' of the table frame 8, which correspond in number and position to and face the operation limiting members 19, 19 affixed to support members 13', 13'.

The vibrations are applied to the molding box 15 both at the time of material feeding in FIG. 1 and at the time of molding in FIG. 2 by the turning force of the motors 26, 26, 26, 26 which is transmitted to the vibration shafts 15', 15' of the molding box 15 through the transmitting belts 28, 28, 28, 28. At this time, the molding box 15 is slightly separated from a pair of stoppers 18, 18, and keeps its balance as if suspended in midair by the thrusting force from the table frame 8 and the tension of the four transmission belts 28, 28, 28, 28 so that the molding box 15 is vibrated uniformly in all the directions, that is, back and forth, left and right, and up and down. As the vibrations generated at this time are appropriately absorbed by the springs 7, 7, 7', 7', 7', 7', 24, 24, they are not transmitted to the frame work of the apparatus.

When the press frame 13 is moved downwardly by the action of the lower oil pressure cylinders 12, 12, and the lower end surface of the plunger 14 (refer to FIG. 1) is brought into contact with the concrete materials in the molding box 15, the oil circuits of the oil pressure cylinders 12, 12 act automatically so as to pull downwardly the respective piston rods 12'. The oil circuits are not shown in the figures.

When the piston rods 12', 12' are pulled downwardly, the upper portion of each piston rod 12' passes freely through the lower surface of the respective support member 13'. However, since each piston rod 12' is equipped with spring means 24 whose upper end is secured to the uppermost portion of the piston rod 12' by a nut via a base plate and whose lower end is secured to the support member 13', the respective springs are compressed when the piston rods 12' are pulled downwardly. When the springs 24, 24 are compressed, the oil circuits of the lower oil pressure cylinders 12, 12 are automatically disconnected and the piston rods do not move any longer. The oil circuits of the lower oil pressure cylinders 12, 12 and their mode of operation are not shown in the figures since they are well known in the field of the present invention. Thus, known oil circuits and limit switches can be used in this invention.

Even if the springs 24, 24 are compressed and the oil circuits are disconnected and accordingly the downward movement of the piston rods 12', 12' is stopped, the press frame 13 still continues to apply pressure to the molding box 15 by the resilience of the springs 24, 24.

When the operation limiting members 19, 19 come into contact with the counterpart operation limiting members 20, 20, the respective oil pressure circuits of the lower oil pressure cylinders 12, 12 are connected again. Thus, the concrete materials in the molding box 15 are molded into concrete-blocks under application of pressure.

During this process, the above-mentioned vibrations are being applied to the molding box 15 so that homogeneous molding is performed.

The reason why pressure is not applied to the molding box continuously only by use of the piston rods 12', 12' under the oil pressure of the lower oil pressure cylinders 12, 12, but instead is applied by the disconnection and connection of the oil circuits during this process is because the compression action of only the springs 24, 24 serves to pack the concrete materials homogeneously into the molding box 15. Therefore, homogeneous concrete-blocks can be molded efficiently.

Figure 3:
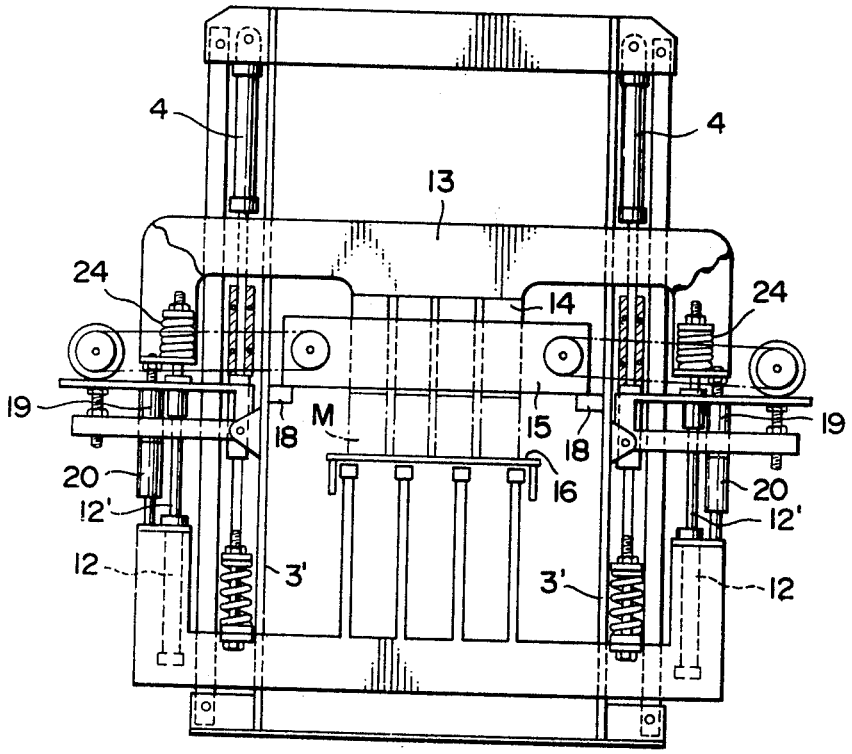
FIG. 3 is a front sectional view of the embodiment of this invention in the ejection process of the molded products.

FIG. 3 is a partly cut-away front elevation of the apparatus during ejection of molded concrete blocks.

When the molding of concrete-blocks is finished, the table frame 8 is allowed to descend by the action of the upper oil pressure cylinders 4, 4 until it engages against and is stopped by stoppers 18, 18 attached to the inner side of each side plate 3'. Thus, the molding box 15 remains on these stoppers, and concrete-blocks M, held between the product receiving plate 16 and the plunger 14, are ejected downwardly from the molding box 15.

Figure 4:
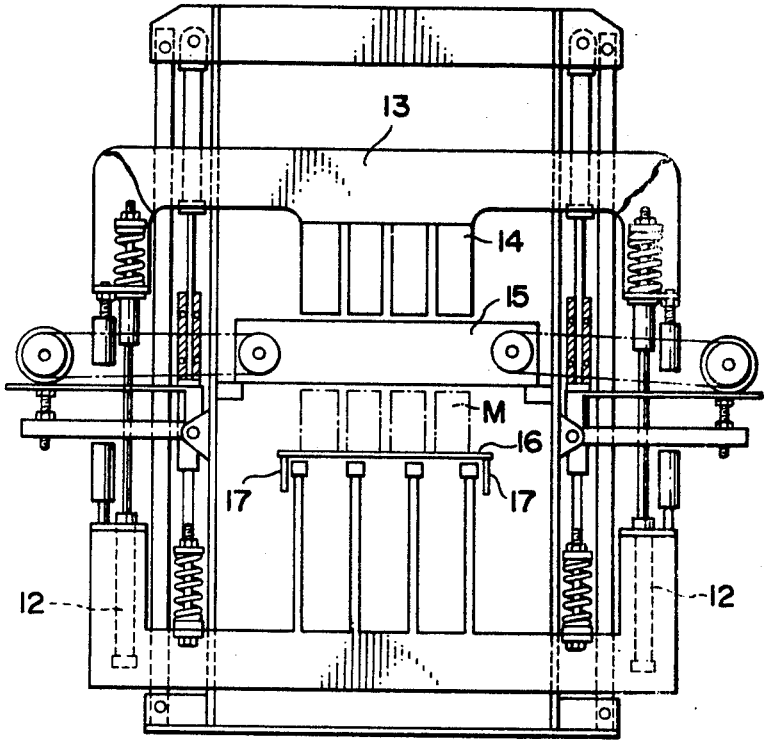
FIG. 4 is a front sectional view of the embodiment of this invention in the product delivery process.

FIG. 4 illustrates a product delivery step.

When the extrusion of the products M is finished, the press frame 13 is pushed upward by the action of the cylinders 12, 12. The plunger 14 is elevated through the inside of the molding box 15 and the products M are delivered by the delivery rails 17, 17.

The products M, being placed on the product receiving board 16, are delivered outside of the apparatus by the delivery rails 17, 17.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for molding concrete-blocks comprising:

a plurality of guide rods secured to an upper support member and a lower support member, said support members being fixedly mounted on a pair of side plates of said apparatus;

a plurality of upper cylinders, each of which includes a piston rod, and which are positioned adjacent to said guide rods and suspended vertically, each of said plurality of upper cylinders including an upper end member being pivotally mounted on said upper support member;

a plurality of suspension members corresponding in number to said piston rods of said upper cylinders and being mounted on a table frame through spring means, wherein a lower end of each of said piston rods of said upper cylinders is connected with each of said suspension members, thereby suspending said table frame;

a plurality of lower cylinders, each of which includes a piston rod, and which are mounted on said table frame through support members thereon;

said plurality of lower cylinders being positioned in parallel with said guide rods, and being disposed on each side of a press frame with said piston rods of said lower cylinders being connected to said press frame through spring means;

a molding box between said table frame and said press frame;

at least one operation limiting member fixed on each side of said table frame which corresponds in number and position to and faces said operation limiting member fixed on each side of said press frame.

2. The apparatus in accordance with claim 1, wherein a total of four motor fixing plates, including two of said motor fixing plates on each side of said apparatus, are pivotally mounted at the outside of both side plates of said apparatus, and four motors being fixed on said motor fixing plates, and a plural number of transmission belts connect between said motors and a plural number of vibration shafts of said molding box.

3. The apparatus in accordance with claim 1, wherein a detachable height limitation member is attached to each piston rod of said upper cylinders.

4. The apparatus in accordance with claim 2, wherein a detachable height limitation member is attached to each piston rod of said upper cylinders.

5. The apparatus in accordance with claim 1, wherein each piston rod of said lower cylinders being connected between said press frame and said table frame, passes through an opening in a support member of said support press frame and is positioned on each side of said support member through springs.

6. The apparatus in accordance with claim 2, wherein each piston rod of said lower cylinders being connected between said press frame and said table frame, passes through an opening in a support member of said support press frame and is positioned on each side of said support member through springs.

7. The apparatus in accordance with claim 3, wherein each piston rod of said lower cylinders being between said press frame and said table frame, passes through an opening in a support member of said support press frame and is positioned on each side of said support member through springs.

8. The apparatus in accordance with claim 4, wherein each piston rod of said lower cylinders being between said press frame and said table frame, passes through an opening in a support member of said press frame and is positioned on each side of said support member through springs.

9. The apparatus in accordance with claim 1, wherein an upper adjustment plate and a lower support board are attached to each of said suspension members and comprising:

a suspension member passing through the approxmate center of each upper adjustment plate and being mounted at the approximate center of each lower support board;

a spring being equipped between each upper adjustment plate and each lower support board, and positioned around said suspension member;

a pair of springs being equipped between each upper adjustment plate and each lower support board, and an adjustment bolt passing through the approximate center of each spring of said pair of springs; and an upper portion of said adjustment bolts being mounted adjacent said adjustment plate, and a lower portion of said adjustment bolts being mounted adjacent said table frame.

10. The apparatus in accordance with claim 2, wherein an upper adjustment plate and a lower support board are attached to each of said suspension members and comprising:

a suspension member passing through the approximate center of each upper adjustment plate and being mounted at the approximate center of each lower support board;

a spring being equipped between each upper adjustment plate and each lower support board, and positioned around said suspension member;

a pair of springs being equipped between each upper adjustment plate and each lower support board, and an adjustment bolt passing through the approximate center of each spring of said pair of springs; and an upper portion of said adjustment bolts being mounted adjacent said adjustment plate, and a lower portion of said adjustment bolts being mounted adjacent said table frame.

11. The apparatus in accordance with claim 3, wherein an upper adjustment plate and a lower support board are attached to each of said suspension members and comprising:

a suspension member passing through the approximate center of each upper adjustment plate and being mounted at the approximate center of each lower support board;

a spring being equipped between each upper adjustment plate and each lower support board, and positioned around said suspension member;

a pair of springs being equipped between each upper adjustment plate and each lower support board, and an adjustment bolt passing through the approximate center of each spring of said pair of springs; and an upper portion of said adjustment bolts being mounted adjacent said adjustment plate, and a lower portion of said adjustment bolts being mounted adjacent said table frame.

12. The apparatus in accordance with claim 4, wherein an upper adjustment plate and a lower support board are attached to each of said suspension members and comprising:

a suspension member passing through the approximate center of each upper adjustment plate and being mounted at the approximate center of each lower support board;

a spring being equipped between each upper adjustment plate and each lower support board, and positioned around said suspension member;

a pair of springs being equipped between each upper adjustment plate and each lower support board, and an adjustment bolt passing through the approximate center of each spring of said pair of springs; and an upper portion of said adjustment bolts being mounted adjacent said adjustment plate, and a lower portion of said adjustment bolts being mounted adjacent said table frame.

13. The apparatus in accordance with claim 5, wherein an upper adjustment plate and a lower support board are attached to each of said suspension members and comprising:

a suspension member passing through the approximate center of each upper adjustment plate and being mounted at the approximate center of each lower support board;

a spring being equipped between each upper adjustment plate and each lower support board, and positioned around said suspension member;

a pair of springs being equipped between each upper adjustment plate and each lower support board, and an adjustment bolt passing through the approximate center of each spring of said pair of springs; and an upper portion of said adjustment bolts being mounted adjacent said adjustment plate, and a lower portion of said adjustment bolts being mounted adjacent said table frame.

14. The apparatus in accordance with claim 6, wherein an upper adjustment plate and a lower support board are attached to each of said suspension members and comprising:

a suspension member passing through the approximate center of each upper adjustment plate and being mounted at the approximate center of each lower support board;

a spring being equipped between each upper adjustment plate and each lower support board, and positioned around said suspension member;

a pair of springs being equipped between each upper adjustment plate and each lower support board, and an adjustment bolt passing through the approximate center of each spring of said pair of springs; and an upper portion of said adjustment bolts being mounted adjacent said adjustment plate, and a lower portion of said adjustment bolts being mounted adjacent said table frame.

15. The apparatus in accordance with claim 7, wherein an upper adjustment plate and a lower support board are attached to each of said suspension members and comprising:

a suspension member passing through the approximate center of each upper adjustment plate and being mounted at the approximate center of each lower support board;

a spring being equipped between each upper adjustment plate and each lower support board, and positioned around said suspension member;

a pair of springs being equipped between each upper adjustment plate and each lower support board, and an adjustment bolt passing through the approximate center of each spring of said pair of springs; and an upper portion of said adjustment bolts being mounted adjacent said adjustment plate, and a lower portion of said adjustment bolts being mounted adjacent said table frame.

16. The apparatus in accordance with claim 8, wherein an upper adjustment plate and a lower support board are attached to each of said suspension members and comprising:

a suspension member passing through the approximate center of each upper adjustment plate and being mounted at the approximate center of each lower support board;

a spring being equipped between each upper adjustment plate and each lower support board, and positioned around said suspension member;

a pair of springs being equipped between each upper adjustment plate and each lower support board, and an adjustment bolt passing through the approximate center of each spring of said pair of springs; and an upper portion of said adjustment bolts being mounted adjacent said adjustment plate, and a lower portion of said adjustment bolts being mounted adjacent said table frame.

17. An apparatus for molding concrete-blocks in which mixed concrete aggregates are supplied from a feed box into a molding box, and the molding of concrete-blocks is performed under application of pressure and vibrations to the molding box, and the molded concrete-blocks are extruded downwardly, said apparatus comprising:

an upper frame;

a pair of side plates secured to said upper frame;

a plurality of parallel guide rods secured to an upper support member and a lower support member and being fixed with respect to said pair of side plates;

a pair of upper pressure cylinders, each having a downwardly extending piston rod and being positioned adjacent to said guide rods and suspended vertically, with the upper ends of said upper pressure cylinders being pivotally mounted on said upper support member, and the lower ends of said piston rods being connected with opposite sides of a table frame through suspension means, whereby said table frame is suspended;

a pair of height limitation members for setting the size of concrete-blocks, which may be replaced in accordance with the size of the concrete-blocks to be molded, each being attached to said piston rods of said upper pressure cylinders;

a press frame disposed between said upper frame and said table frame and provided with a mold plunger;

a pair of lower pressure cylinders, each having an upwardly extending piston rod and being positioned adjacent to said guide rods, with the upper ends of said upwardly extending piston rods being connected with opposite sides of said press frame through spring means, and said lower pressure cylinders being fixed to opposite sides of said table frame;

a molding box between said table frame and said press frame;

a plurality of pairs of operation limiting members fixed to opposite sides of said press frame;

a plurality of pairs of operation limiting members fixed to opposite sides of said table frame which correspond in number and position to and face said operation limiting members fixed to the opposite sides of said press frame;

a plurality of supports fixed on said table frame, which have shock absorbing members thereon and support a product receiving plate;

said molding box suspended between said mold plunger and said product receiving plate being provided with a pair of vibration shafts which are disposed at opposite sides of said molding box;

four motor fixing plates, two of said motor fixing plates being pivotally mounted on an outer surface of each of said side plates;

four motors respectively mounted on said motor fixing plates; and a plurality of transmission belts connecting said motors with said vibration shafts of said molding box, whereby said molding box is suspended.

18. An apparatus as claimed in claim 17, wherein said suspension means comprises:

an adjustment plate and a support plate with each piston rod of said upper pressure cylinders passing freely through the center of said adjustment plate;

a lower end of said piston rod being mounted to said support plate;

spring means being interposed between said adjustment plate and said support plate;

a pair of adjustment bolts pass freely through opposite sides of said support plate with the respective upper ends of said adjustment bolts being mounted to said adjustment plate, and the lower ends thereof being mounted to said table frame; and each of said adjustment bolts being equipped with spring means interposed between said adjustment plate and said support plate.

* * * * *